United States Patent [19]

Cancio

[11] 4,427,859

[45] Jan. 24, 1984

[54] HIGH VOLTAGE POWER SWITCH

[75] Inventor: Modesto-Manuel Cancio, Fislisbach, Switzerland

[73] Assignee: BBC Brown, Boveri and Company, Limited, Baden, Switzerland

[21] Appl. No.: 275,348

[22] Filed: Jun. 18, 1981

[30] Foreign Application Priority Data

Jun. 23, 1980 [EP] European Pat. Off. ..... 80200596.7

[51] Int. Cl.[3] ..... H01H 33/18

[52] U.S. Cl. ..... 200/148 B; 200/147 R; 200/148 R

[58] Field of Search ..... 200/148 B, 148 A, 147 R

[56] References Cited

U.S. PATENT DOCUMENTS 4,218,597 8/1980 Kii ..... 200/148 B 4,286,128 8/1981 Ruffleux et al. ..... 200/148 B

*Primary Examiner*—Robert S. Macon

*Attorney, Agent, or Firm*—Burns, Doane, Swecker & Mathis

[57] ABSTRACT

A high voltage power switch has a stationary contact and an axially displaceable contact, with a nozzle-like orifice through which quenching gas flows during the disconnecting process from a quenching chamber to an expansion chamber, and a coil through which the disconnect current flows after the commutation of the disconnect arc to an annular contact. Between the stationary contact and the annular contact at least one exhaust channel is provided, whereby prior to the commutation of the disconnect arc to the annular contact, the quenching gas heated by the disconnect arc is removed from the contact-break path and conducted into a discharge chamber. This feature enables the dielectric strength of the arc path to be increased by simple means, while simultaneously effecting a commutation of the disconnect arc from the stationary arcing contact to the annular contact in a constantly secure manner.

6 Claims, 2 Drawing Figures

HIGH VOLTAGE POWER SWITCH

BACKGROUND OF THE INVENTION

The present invention relates to a high-voltage power switch of the type having a stationary contact, an axially displaceable contact, a nozzle through which compressed gas flows from a compression chamber to an expansion chamber during quenching of an arc, and an electromagnetic coil surrounding the stationary contact.

A switch of this type is disclosed in European Patent Application No. 4,213. In this type of switch, an electric arc burns initially during disconnection of the stationary contact and the moving contact. As soon as the bases, or end points, of the arc are at a certain distance from each other, the base located on the stationary contact migrates onto an annular contact connected to one terminal of a coil, the other terminal of the coil being electrically coupled with the stationary contact. When the arc has been commutated to the annular contact, the current to be interrupted flows through the coil. The magnetic field of the coil causes the arc to rotate, whereby the surrounding compressed gas is heated and the extinction of the arc is effected.

The rotation of the arc on the annular contact provides a significant advantage in that the formation of metal vapors is largely prevented, assuring high dielectric strength in the distance between the separated contacts. Immediately following the contact separation, prior to the commutation to the annular contact, the arc is burning between the stationary and the moving contacts, without a significant local displacement of its bases. Depending on the magnitude of the current to be disconnected, burned parts and metals are evaporated; reducing the dielectric strength of the arc path.

The main object of the invention is therefore to provide a novel high voltage power switch wherein an increase in the dielectric strength of the arc path is effected by simple means and the commutation of the arc onto the annular contact is accomplished safely.

This object is attained by providing a radial exhaust channel between the stationary and annular contacts to enable the insulating gas to flow into an expansion chamber. The switch according to the invention achieves its objective by causing combustion products and metal vapors, which are produced between the contacts in the course of each switching process and which reduce the dielectric strength of the contact-break path, to be removed from the heated compression chamber, and thus from the arc path, and transported into a closed, cooled discharge chamber, wherein they are deposited on the walls in the form of solids. The dielectric properties of the compressed gas used to extinguish the arc are thereby significantly improved. Furthermore, the communication of the arc from the stationary contact to the annular contact is always achieved with certainty, since an outwardly directed radial flow of compressed gas is present during the entire disconnecting phase.

By providing two expansion chambers connected by a one-way valve, the return of the arc, after commutation, from the annular contact to the stationary contact is safely prevented even during the disconnection of a very large current, because the flow of the quenching gas is always directed in a radially outward direction. Therefore, if in the course of the disconnection of an extremely large current, the quenching gas in the part of the compression chamber defined by the stationary contact and the annular contact is heated to the extent that the volume of the discharge chamber is unable to receive the radially outward flowing gas completely, the gas conducted into a supplemental volume once it reaches a predetermined value of pressure.

It is convenient to design the discharge chamber with porous or sintered walls, since in this manner the heated quenching gases are cooled better and the combustion and metal parts volatilized by the arc are condensed more rapidly.

Further in accordance with features of the invention, an axially movable pin can be used to close off an orifice in the movable contact during part of the disconnecting operation, so that during the switching of small currents, the pressure of the quenching gas is built up in the commutating chamber to a level sufficient to insure the commutation of the arc from the stationary contact to the annular contact. A particularly effective blowing of the arc is obtained when the switch according to the invention is designed with a pin having the shape of a nozzle.

The features and advantages of the present invention will become more apparent from a perusal of the following detailed description of a preferred embodiment thereof illustrated in the accompanying drawings.

DETAILED DESCRIPTION

Figure 1:
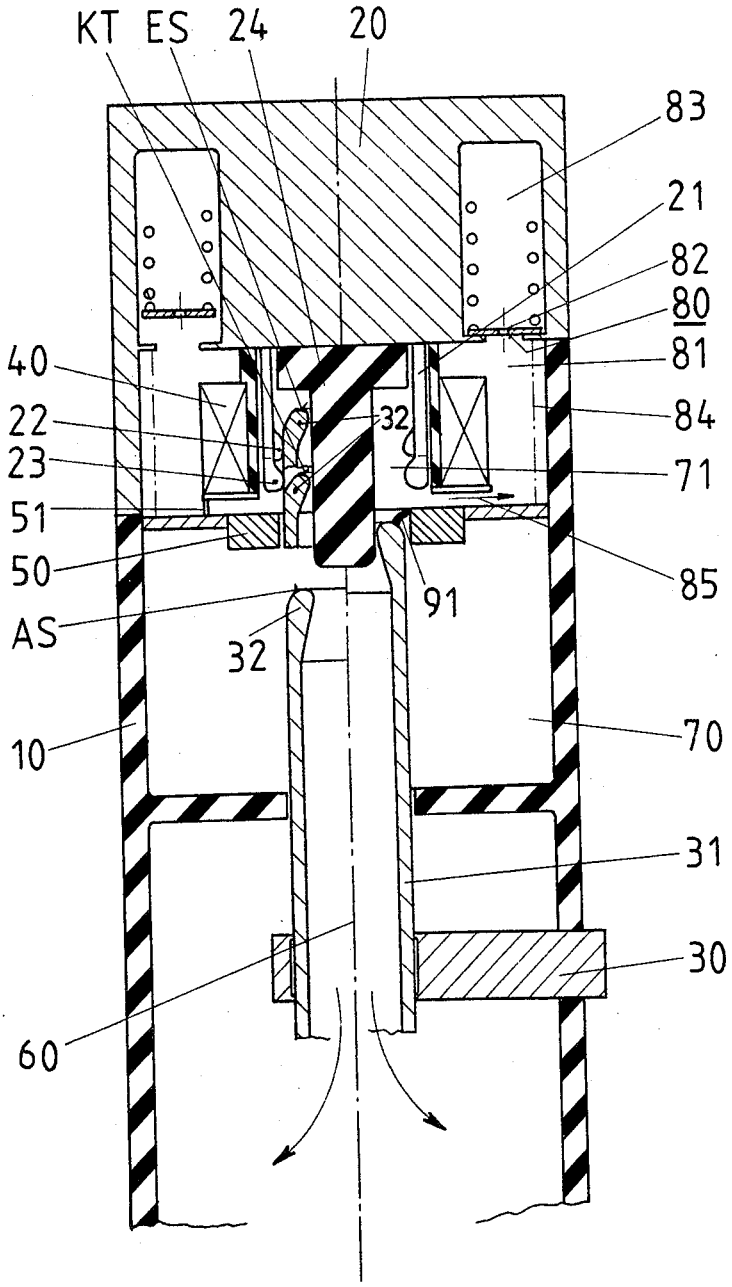
FIG. 1 is a cross-sectional side view through a preferred embodiment of the high voltage power switch according to the invention, wherein the left half of the FIG. shows the switch in the closed position (ES) and the right half of the FIG. shows the switch in the circuit breaking position (AS) at the onset of commutation of the arc to the annular contact.

In the FIGS., similar parts are provided with the same reference symbols. The symbol 10 designates a housing filled with an insulating gas, such as $SF_6$, and sealed on one side by means of a current terminal 20. Inside the housing 10 is a stationary contact 21 and a movable contact 31. The stationary contact 21 is hollow and has a constant contact 22 and an arcing contact 23 with the configuration of a finger. Inside the stationary contact 21, a pin of insulating material 24 is provided, which serves to reduce the volume of the gas enclosed by the stationary contact 21. A cylindrical coil 40, surrounding the stationary contact, is connected at one end with the stationary contact 21 and at the other end to an annular contact 50 by means of a web 51. The annular contact is axially offset with respect to the stationary contact 21. The movable contact 31, placed in electrically conducting contact with a current terminal 30 by means of contact bars (not shown), has a hollow configuration and has at its arcing end an orificed nozzle 32. The nozzle 32 separates a quenching chamber 70 surrounding the movable contact 31 on the arcing side, wherein the pressure of the $SF_6$ gas is increased by means of heating a rotating disconnecting arc 92, from an expansion chamber 60, which the heated $SF_6$ gas enters following the opening of the orifice of the nozzle 32.

A commutating chamber 71, defined by the stationary contact 21, the insulating pin 24, the annular contact 50 and the nozzle shaped arcing contact 32, is connected with an expansion chamber 80 by means of a relief channel 85 in the form of an annular slit. The expansion chamber is enclosed by walls 84, and has two chambers 81, 83 that are interconnected through a one-way valve 82.

Figure 2:
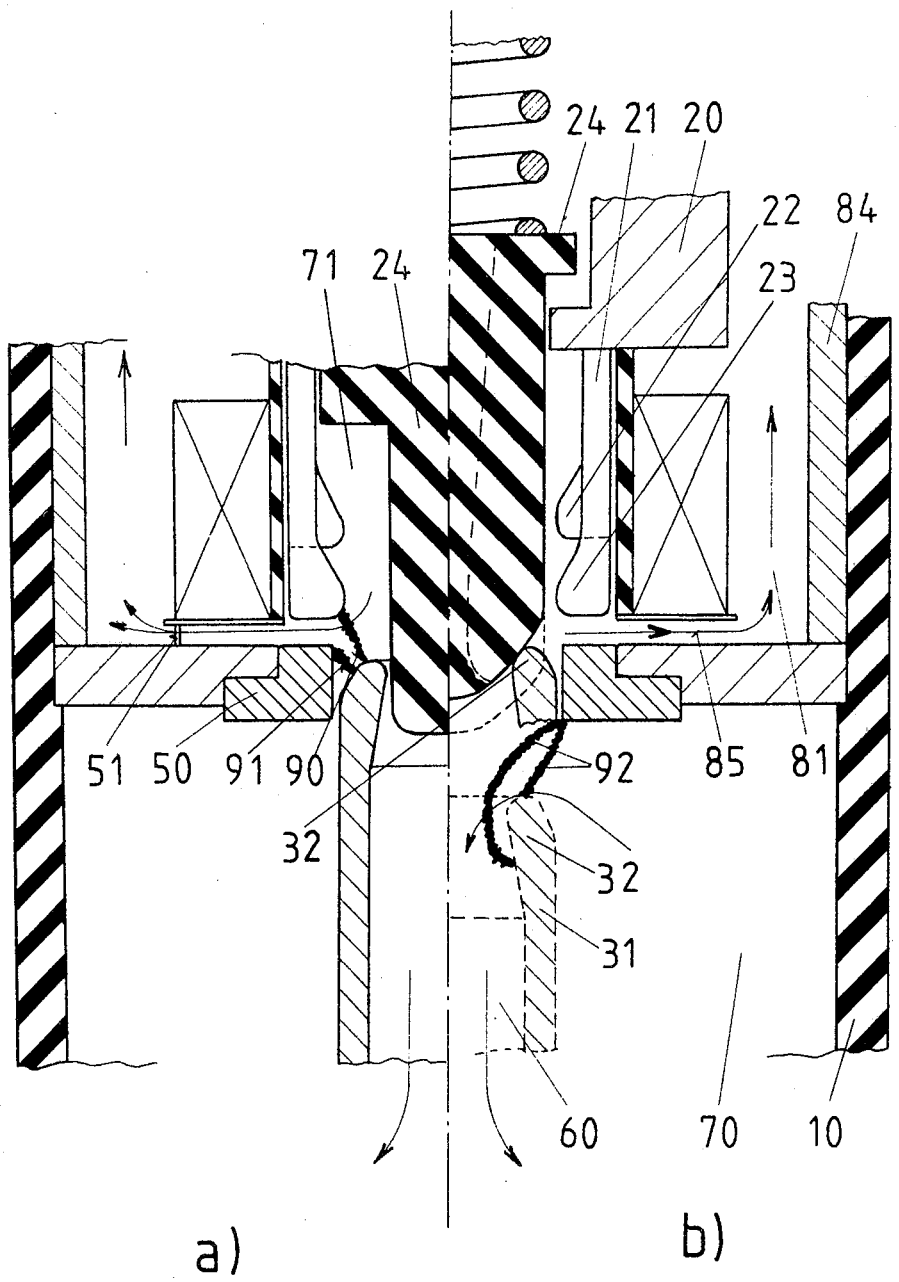
FIGS. 2*a* and 2*b* are cross-sectional side views of the switch in an enlarged representation, wherein the switch in the left part (a) of the Figure is shown in the commutating phase and in the right part (b) before and after the commutating phase.

The mode of operation of the high voltage power switch is as follows:

In the closed position of the switch (position ES in FIG. 1), the movable contact 31 penetrates the annular contact 50 and forms a contact stud overlap with the stationary contact 21. During disconnection, initially the two constant current contacts 22 and 31 are separated from each other and the current to be interrupted flows through the arcing contact 23 to the movable contact 31. As soon as the connection between the arcing contacts 23 and 31 is eliminated (position KT in FIG. 1), an arc, (not shown in FIG. 1) is formed between the two contacts. This arc heats the quenching gas present in the commutating chamber 71 and raises its pressure. The heated quenching gas then flows through the annular slit 85 into a first chamber 81 of the expansion space 80. This flow of gas is indicated in FIGS. 1, 2*a* and 2*b* by arrows. FIG. 2*a* further illustrates how the arc 90 burning between the arcing contacts 23 and 32 is blown by this flow of gas from the arcing contact 23 onto the annular contact 50. This effects a commutation of the current to be interrupted to the coil 40. The current now flows from the current terminal 20 by way of the coil 40, the connector 51, the annular contact 50, the arc 91 between the annular contact 50 and the arcing contact 32, and the arcing contact 32 to the current terminal 30 (FIG. 2*a*).

At least until the instant of the commutation of the arc 90 from the arcing contact 23 to the annular contact 50, the heated quenching gas may escape only through the annular slit 80. The quenching gas thereby removes combustion residues and metal vapors, generated by the arc 90 burning between the arcing contacts 23 and 32. The walls 84 of the expansion chamber 80 preferably contain a porous, sintered material or a material equipped with a cooling lamination, whereby a satisfactory cooling of the quenching gas is effected and the combustion residues and the metal vapors are collected in a particularly effective manner.

During the disconnection of extremely high short circuit currents it is possible that the first chamber 81 of the expansion space 80 can no longer take the heated quenching gas. It is therefore desirable to connect the first chamber 81 by means of a one-way valve 82 with a second chamber 83, whereby the excessive quenching gas may be exhausted by the actuation of the valve 82 once the gas reaches a predetermined value of pressure.

At the instant when the arc 90 is commutated onto the annular contact 50 and the disconnecting current flows through the coil 40, the arc 91 begins to rotate very rapidly under the effect of the magnetic field of the coil 40 (FIG. 2*a*). The quenching gas is thereby heated even stronger, while, however, the formation of combustion residues and metal vapors is largely prevented by the rotation of the arc. The heated quenching gas is conducted away through the annular slit 85 and thereby removes any combustion and metal residues that may still be present.

When the orifice of the nozzle 32 on the moving contact 31 that was previously closed off by an insulating pin 24 is opened and the penetration of the moving contact 31 through the annular contact 50 is eliminated, the quenching gas is heated by the rotating arc 92 in the quenching chamber 70 to its quenching pressure and conducted through the nozzle orifice of the contact 31 to the expansion chamber 60. Here, as shown in FIG. 2*b*, the arc 92 is exposed to intensive blowing, driven into the orifice of the nozzle 32 of the moving contact 31 and extinguished. The motion of the moving contact 31 is arrested following the extinction of the arc 92 in the position AS shown in the left half of FIG. 1 (disconnect position).

As represented in FIG. 2*a*, the pin of insulating material 24 that closes off the nozzle 32 of the moving contact 31 during the initial phase of the disconnecting process may have the configuration of a follower pin. The pin 24 is exposed in the closed position of the switch to the effect of stored energy, such as a spring, and follows the moving contact 31, until the arc is commutated onto the annular contact 50 (position indicated by the broken line in FIG. 2*b*). The insulating pin 24 may be equipped with a bore (also shown by a broken line in FIG. 2*b*), whereby following the commutation of the arc onto the annular contact 50, and the uncovering of the bore by the movable contact 31, the arc 92 is exposed to double blowing.

The present invention may be embodied in other specific forms without departing from the spirit or essential characteristics thereof. The presently disclosed embodiment is therefore considered in all respects as illustrative and not restrictive. The scope of the invention is indicated by the appended claims rather than the foregoing description, and all changes which come within the meaning and range of equivalency of the claims are therefore intended to be embraced therein.

What is claimed is:

1. A high-voltage power switch comprising:

a stationary contact;

an axially displaceable contact having a nozzle through which compressed gas flows from a compression chamber to an expansion chamber during a current breaking process;

an annular contact axially displaced from said stationary contact;

a cylindrical coil surrounding said stationary contact and connected between said stationary contact and said annular contact;

a commutation chamber defined by said stationary contact and said annular contact;

an expansion chamber disposed outside of said stationary contact and having a volume sufficient to accomodate gas compressed in said commutation of an arc from said stationary contact to said annular contact; said expansion chamber having at least two chambers connected with each other by means of one-way valve; and a radially disposed exhaust channel between said stationary contact and said annular contact for connecting said commutation chamber to said expansion chamber.

2. The high-voltage power switch of claim 1, wherein the walls of the expansion chamber are of a porous, sintered material.

3. The high-voltage power switch of claim 1, wherein the walls of said expansion chamber have a cooling lamination.

4. The high-voltage power switch according to claim 1 further including a pin of insulating material disposed in said commutation chamber for closing off the orifice of said nozzle prior to the commutation of the arc to said annular contact.

5. The high-voltage power switch of claim 4, wherein said insulating pin is axially displaceable and is supported in the closed position of the switch against the movable contact under the effect of a charged means of energy storage.

6. The high-voltage power switch of claim 4, wherein said pin of insulating material has the configuration of a nozzle.

* * * * *